US006457994B1

(12) United States Patent
Johnson et al.

(10) Patent No.: US 6,457,994 B1
(45) Date of Patent: Oct. 1, 2002

(54) MEDIA CONNECTOR THAT ALLOWS ELECTRICAL COMMUNICATION TO BE ESTABLISHED WITH A MEDIA PLUG

(75) Inventors: Thomas A. Johnson, Draper; Patrick A. Tucker, Sandy; Steven Loforte, Copperton; David Oliphant, West Jordan, all of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/842,937

(22) Filed: Apr. 26, 2001

Related U.S. Application Data

(63) Continuation-in-part of application No. 09/687,233, filed on Oct. 12, 2000.

(51) Int. Cl.[7] ..... H01R 12/24

(52) U.S. Cl. ..... 439/492; 439/131; 439/329; 439/676; 439/946

(58) Field of Search ..... 439/131, 492, 439/329, 676, 946, 71, 607, 608

(56) References Cited

U.S. PATENT DOCUMENTS 5,634,802 A * 6/1997 Kerklaan ..... 439/131
6,115,256 A * 9/2000 Centofante ..... 361/37

* cited by examiner

*Primary Examiner*—Tho D. Ta
*Assistant Examiner*—Trac Nguyen
(74) *Attorney, Agent, or Firm*—Workman, Nydegger & Seeley

(57) ABSTRACT

A media connector assembly with an extended electrical contact capable of non-destructive deflection when various media plugs are placed therein that do not accommodate each contact pin within the media connector. The media connector includes a platform with an arched mid-portion for enlarging the radius of deflection of the contact pins such that the contact pins deflect when a media connector is placed therein at a position further from the aperture receiving the media connector. The arch maintains curved support for the deflected contact pin and assists in the positive contact force applied by the contact pin to the contact of the media plug.

25 Claims, 4 Drawing Sheets

MEDIA CONNECTOR THAT ALLOWS ELECTRICAL COMMUNICATION TO BE ESTABLISHED WITH A MEDIA PLUG

RELATED APPLICATIONS

This application is a continuation-in-part of copending application Ser. No. 09/687,233, entitled "Electrical Compression Connection for Retractable Connectors" filed Oct. 12, 2000 and commonly assigned with the present invention, and incorporated herein by reference.

BACKGROUND OF THE INVENTION

1. Field of the Invention

The present invention relates to the field of computer media connectors. More particularly, the present invention relates to multifunction media connectors that are configured to couple with multiple media plugs.

2. The Prior State of Related Art

Various communication systems are used to allow electronic devices, such as laptop computers, to communicate and exchange data and other types of information. For example, various networks, including Local Area Networks (LAN), Internet, Ethernet and conventional telephone networks, often link computers. These known communication systems, usually require the computer to be physically connected to telephone lines, modems or specialized wiring. Integration of LAN systems and modem telephone systems onto portable electronic devices, and more specifically onto a portable expansion card, allow a computer to provide a user with a communication outlet to the previously mentioned networks.

Portable expansion cards were developed when the industry recognized that standardization of peripheral devices would, among other things, greatly increase the demand for them. Exemplary portable expansion cards include solid-state interface cards, PC Cards, ATA (Advanced Technology Attachment) cards, Compact Flash cards, SmartMedia cards, SSFDC (Solid State Floppy Disk Cards), or other miniature expansion card devices. Several manufacturers collaborated to form the Personal Computer Memory Card International Association (PCMCIA), which developed and promulgated standards for the physical design, dimensions, and electrical interface of portable expansion devices.

Specifically, the PCMCIA PC Card standard identifies three primary card types: Type I, II, and III. These PC Card types correspond to physical dimension restrictions of 85.6 mm (length)×54.0 mm (width) and height restrictions of up to 3.3 mm (Type I), 5.0 mm (Type II), and 10.5 mm (Type III). Now, many electronic devices being manufactured, especially those having a reduced size, are adapted to accommodate these standards. Laptop computers, in particular, are increasingly popular for both business and personal applications due in part to the development of PC Card peripheral devices designed to increase the functionality of the computers. As an example, PC cards are commonly used with portable and laptop computers to provide added features and/or functions. For instance, PC cards are often configured to function as memory cards, network interface cards (NIC), sound cards, modems, or other devices that supply add-on functionalty. Often, portable expansion cards such as network interface cards (NICs) or modem cards are used to allow or facilitate communication with an external system or device such as the Global Information Network or the public telephone network.

The ability to communicate with the external system, however, relies on connectors that provide an electrical connection between the portable expansion card and the external system. For example, the public telephone system is usually accessed through wall jacks that are designed to receive RJ series media plugs. Understandably, the connector of a modem card that is connecting with the public telephone system is also configured to receive RJ series media plugs. The physical shape of the connector can be varied to accommodate other types of plugs and to enable connections with different systems.

When the media plug is removably connected with the connector of the portable expansion card, an electrical connection is formed at this interface that permits the card to electrically communicate with the external system, which can be a network, the public telephone system, or the like. In one example, the card's connector has an aperture formed in the body of the connector that is shaped and sized to removably receive a similarly shaped and sized media plug. As previously described, the aperture is often shaped and configured to receive RJ type media plugs. Contact pins, which are attached to the connector, extend freely into the aperture of the connector that receives the media plug. The media plug has contacts that are positioned on the media plug to come into contact with the contact pins when the media plug is inserted into the connector. The physical contact between the contact pins and the media plug contacts form the electrical connections through which the portable expansion card can communicate with the external system.

For a movable interface, such as a retractable connector, it should be appreciated that such interfaces that have two fixed bodies, such as (i) a printed circuit board associated with the portable expansion card and (ii) a media connector, which provides electrical continuity therebetween. One approach for providing such electrical continuity has been to use a flex circuit having electrical traces thereon. Flex circuits are flexible ribbon-like wiring harnesses that retain sufficient rigidity and flexibility during extension and retraction of the media connector in reference to the printed circuit board to sustain an enduring electrically conductive conduit. Attachment at the terminal ends of the flex circuit has heretofore been performed by either (i) solder-connections of the flex to fixed pads or post on the printed circuit board and media connector, or (ii) piercing electrically conductive posts on the printed circuit board and the media connector through conductive pad regions on the flex circuit thereby creating an electrical interconnect held largely in place by the stresses associated with the pierced and deformed flex circuit about the piercing post. Over time and frequently during initial assembly, such interfaces are unreliable and unaccommodating for reworking or repairing the electronic device. It would be an advancement in the art to provide a more accommodating and reliable interface between the flex circuit and the stationary components of the electronic device, such as between the media connector and the flex circuit.

An additional aspect to a media connector of further concern relates to the contact pins that physically interface with the media plug. It is important to ensure that the contact pins do not fracture, improperly bend, or otherwise malfunction in order to maintain an effective electrical connection. Because a media plug is repeatedly inserted and removed from a media connector, the contact pins are usually designed to flex within a prescribed range of motion and if the movement of the contact pins exceeds this limited range of motion, the contact pins may fracture or otherwise malfunction. Similarly, hindering the movement or flexibility of the contact pins can cause the contact pins to fracture or otherwise malfunction.

Another problem associated with the contact pins is the ability to properly position the contact pins within the media connector. Sometimes, one or more of the contact pins can be moved or shifted to a different position. This presents at least two problems. First, the misplaced contact pins can come into contact with other contact pins, which often results in an electrical short. Second, the misplaced contact pins may not come into contact with a corresponding contact of a media plug. In this instance, the electrical connection is not formed at the media connector and the card is not in electrical communication with the external system.

Further, when a media plug is inserted into a media connector, the contact pins bend and usually place separation forces on the other contact point in the media connector. Because these stresses may cause separation of the contact pins from the electrical contact pad points, a loss of the electrical connections and a number of different problems can occur. For example, if the contact pins do separate from the electrical contact pads, the signals cannot be transferred with the external network. Further, the user risks electrical damage to the contact pins or the media plug contacts when they move on the electrical contact pad surfaces. Previous attempts to fixably position the contact pins onto specific electrical contact pad points has irreparably damaged the connecting means between the media connector and the portable expansion card. Others have attempted a more costly approach by fixably soldering the individual contact pins to the electrical contact pad points, but over time the natural flex introduced by the insertion and removal of external media connectors breaks the solder joint, thereby reducing the overall reliability.

Additionally, a connector or socket is typically formed and configured to receive a specific type or size of a media plug. In order to facilitate various media plugs, multiple media connectors or sockets have been developed. Such a myriad of connectors on a device, however, consumes much of the available exposed end on the PC card or edge of the device. One problem with a typical RJ-type socket or connector, however, is that they are not designed to securely couple with both, for example, an RJ-11 series media plug and an RJ-45 series media plug. One of the reasons for this is that the RJ-11 series media plugs and the RJ-45 series media plugs are not the same dimensions. An RJ-11 media plug has six contact pin placements and the RJ-45 has eight contact pin placements. To accommodate the extra pin placements, the body of an RJ-45 media plug is wider than that of an RJ-11 media plug.

A socket that is configured to securely couple with an RJ-11 series is too narrow to receive the body of a RJ-45 series plug. In contrast, a socket that is configured to receive the body of a RJ-45 series plug is too wide to securely couple with a RJ-11 series plug. Accordingly, many electronic apparatus and associated peripheral computer card devices are configured to have at least two sockets or connectors, one to accommodate RJ-45 series plug for LAN connections and the other to accommodate RJ-11 series media plugs for modem connections.

As described above, the flexibility and reliability of connector contact pins is paramount. For example, it is not reliable to employ a traditional RJ-45 connector socket for use with both RJ-45 and RJ-11 media plugs because the RJ-11 media plug is comprised of molded shoulders located at the positions of the outer most two contact pins of the typical RJ-45 connector contact pin locations. Because of this high profile in the shoulder-corresponding pin locations, the contact pins in the connector socket of traditional RJ-45 connectors become overly deflected and fractured resulting in kinked and therefore unreliable contact pins in the outer most RJ-45 connector contact pin locations.

Therefore, it would be desirable to have a multi-function connector or socket that facilitates the reception of both RJ-11 and RJ-45 media plugs without causing deleterious effects upon the contact pins of the media connector or socket.

SUMMARY OF THE INVENTION

The present invention has been developed in response to the current state of the art, and in particular, in response to these and other problems and needs that have not been fully or completely solved by currently available connectors. In one embodiment, the present invention provides a compressible contact between a media connector assembly and a flexible circuit. Electrical contact is made via the flex circuit through conductive contact pins associated with an RJ or modular type socket and plug. Two plastic posts are molded into a platform of the media connector assembly to align with the flex circuit, which has opposing holes, and is inserted over the tops of the posts. This alignment creates a positive stop and lock for the flex circuit increasing the reliability and reducing the production technology needed for alignment thereby reducing the production cost. The contacts pins are seated directly over the electrical contact pads of the flex circuit and a top "cap" cover is pressed onto the media connector assembly. Molded locking features on the media connector assembly secure the entire system including the cover, the contact pins, the flex circuit, and the platform. Thus, one strategic advantage to this invention is the development of a connector assembly system, which does not require specialized soldering or other unique processing equipment and lends itself to automated assembly and rework.

In one embodiment, assembly of the media connector includes a cover which is locked into place causing the contact pins to properly align via a specially designed arch in the platform and compressed against the electrical contact pads. The arch has guide fins that position, isolate, and flexibly limit the contact pins of a media connector assembly. The natural flexibility of the contact pins caused by an inserted media plug is limited by the arch to prevent breakage of the contact pins and the contact pins are isolated to ensure that a proper electrical connection is established. In addition to connecting the media connector assembly to a portable expansion card, the flexible circuit also provides a protective element to the contacts of the media connector assembly, such that the electrical connections formed by the union of a media plug and a media connector are protected and insulated. This is accomplished with a shield that extends from the media connector to protect and insulate the electrical connection between the media connector and the media plug.

In one preferred configuration, the media connector includes an arch disposed within the body of the media connector. The contact pins of the media connector that electrically touch the contacts of the media plug extend over the arch and into an aperture of the media connector. The arch includes guide ribs that ensure that the contact pins do not touch each other and that the contact pins are properly positioned.

Another related configuration provides a shield positioned beneath the arch with respect to the contact pins, the shield extends out from the body of the media connector beneath the contact pins. The shield is made of a relatively stiff material that does not become misshaped during use. The stiffness of the shield ensures that the electrical connection between the media connector and the media plug will be covered and that the shield will not fall away from the electrical connection. In effect, the stiffness of the shield ensures that the shield will exert a slight pressure against the contact pins without interfering with their movement as the media plug is repeatedly inserted and removed from the media connector. The shield exits the media connector through an arch channel. The arch includes an arch exit channel shaped such that the shield will be flush with a surface of the media connector when the media connector is in a retracted position. In other words, because the shield exits the body of the media connector, the added thickness of the shield can potentially interfere with the retraction of the media connector. The arch exit channel permits the media connector to be easily retracted and extended by allowing the shield to move within the confines of the media connector during retraction. Because the shield is beneath the arch, the shield does not interfere with the mechanical and electrical operation of the contact pins, and as a result, the movement of the contact pins is not hindered by the shield and the contact pins are therefore less likely to fracture or otherwise malfunction. Also, the shape of the shield does not have to be altered in order to accommodate the contact pins because the shield and the contact pins are positioned on opposite sides of the arch.

The present invention also includes embodiments capable of multifunction connections with various dimensioned media plugs. The present invention includes a media connector assembly with an extended electrical contact capable of non-destructive deflection when various media plugs are placed therein that do not accommodate each contact pin within the media connector. The media connector includes a platform with an arched mid-portion for enlarging the radius of deflection of the contact pins such that the contact pins deflect when a media connector is placed therein at a position further from aperture receiving the media connector. The arch maintains curved support for the deflected contact pin and assists in the positive contact force applied by the contact pin to the contact of the media plug.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to both methods and systems of communication using extendable/retractable media connectors associated with portable expansion devices. The present invention relates to compression fittings for a retractable media connector for use in reliably positioning, maintaining, shielding, protecting and insulating electrical connections formed between media connector pins and a flexible circuit. The present invention also relates to multifunction connectors for receiving either an RJ-11 or RJ-45 media plug therein. The present invention is described in terms of a media connector for use with a portable expansion card, but it is understood that the teachings of the present invention extend to electronic devices employing retractable media connectors. The present invention is therefore not limited to use with a portable expansion card nor to retractable connectors. The embodiments of the present invention may comprise a special purpose or general-purpose computer electrically connected to a portable expansion device configured for communication via various computer hardware configurations, as discussed in greater detail below.

Embodiments within the scope of the present invention also include portable expansion devices for carrying or having retractable/extendable media connector assembly stored thereon. Such portable expansion devices can be any available media that can be accessed by a general purpose or special purpose computer. By way of example and not limitation, such portable expansion devices can comprise solid-state interface cards, PCMCIA PC Cards, ATA (Advanced Technology Attachment) cards, Compact Flash cards, SmartMedia cards, SSFDC (Solid State Floppy Disk Cards), other miniature expansion card devices, or any other medium which can be used to carry or store desired connector means in the form of retractable/extendable media connector and which can be accessed by a general purpose or special purpose computer. The retractable/extendable media connector facilitates communication from a special purpose or general-purpose computer to a network or another communications connection via either a wired connection or a combination of hardwired or wireless connections.

Figure 1:
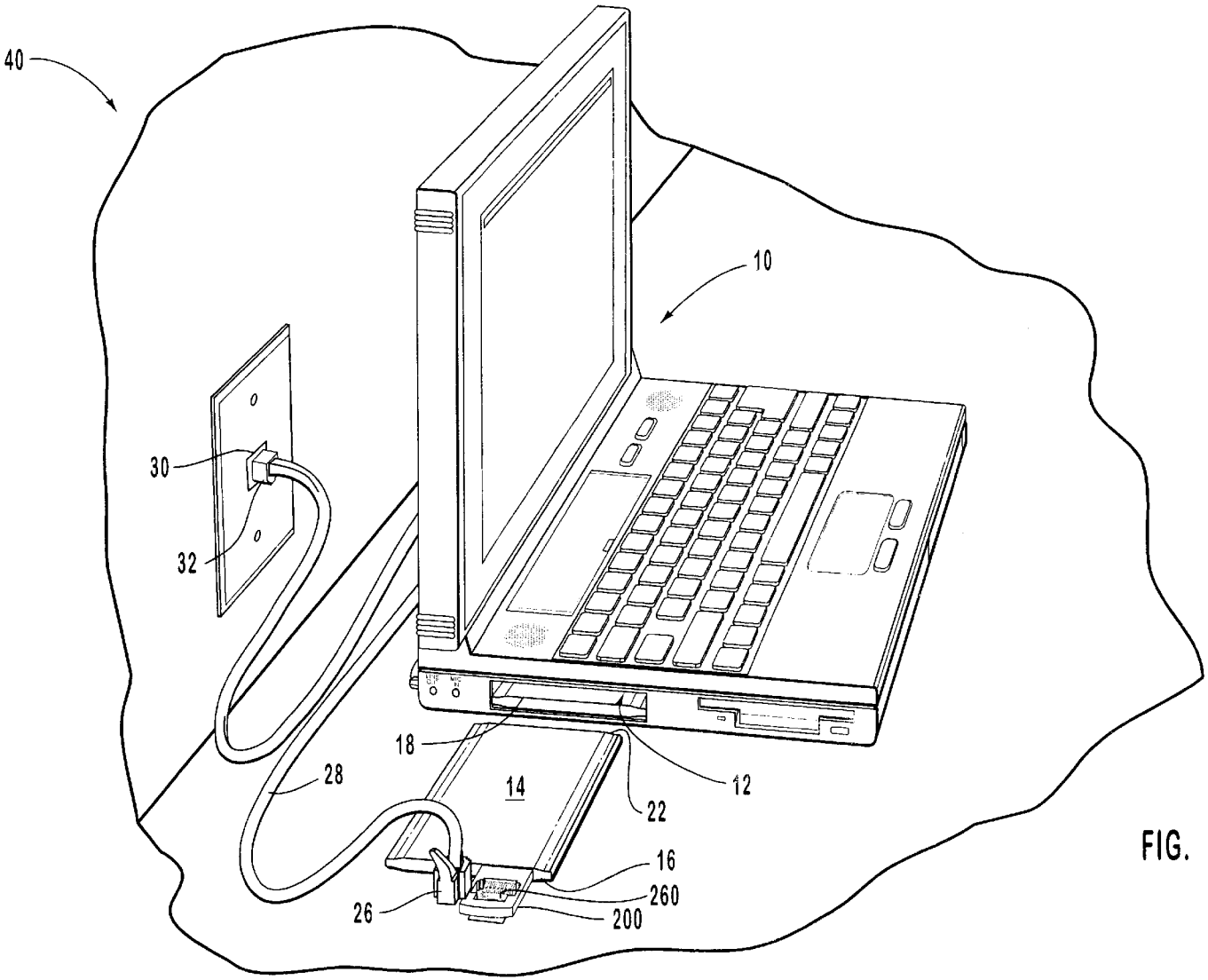
FIG. 1 illustrates an exemplary system that provides a suitable operating environment for the present invention.

FIG. 1 and the following discussion are intended to provide a brief, general description of a suitable computing environment 40 in which the invention may be implemented. Although not required, the invention will be described in the general context of portable expansion devices, such as PC Cards, that integrate media connectors, such as RJ type sockets or plugs, within the portable expansion device to enable electronic devices such as laptop computers to communicate in network environments. Generally, retractable media connectors include flexible coupling means, contact pins, and a platform with an aperture for receiving a media plug connected to a feeding transmission line.

With reference to FIG. 1, an exemplary system or environment 40 for implementing the invention includes a general-purpose computing device in the form of a conventional laptop computer 10, including a processing unit, a system memory, portable expansion slots 12, and a system bus (not shown for clarity) that couples various system components including the expansion slots to the processing unit. The portable expansion slot 12 is configured to receive portable expansion devices 14 and 18. Expansion slots 12 allow for insertion of the aforementioned upgrade modules into standard compatible slot interfaces, such as the PCMCIA PC Card standard that identifies three primary card types: Type I, II, and III. The PCMCIA interface is electrically connected to the system bus. The system bus may be any of several types of bus structures including a memory bus or memory controller, a peripheral bus, and a local bus using any of a variety of bus architectures. The interface 22 of portable expansion device 14 is configured to detachably connect with a high-speed connector (not shown) inside slot 12. Inserting portable expansion device 14 in slot 12 permits portable expansion device 14 to be in electrical and physical communication with computer 10.

On the other end of the card 14 is a media connector 200 that serves as a mechanical and electrical interface between the card 14 and an external network such as the public telephone network, local area network (LAN), or wide area network (WAN). FIG. 1 also illustrates a media connector 200 that is extended from the body of the card 14. The media connector 200 may also be retracted within the body of the card 14. In this example, the media connector 200 is illustrated as being configured to receive an RJ-type media plug, but the media connector 200 is intended to be illustrative of a wide variety of connectors, including other RJ type sockets, 15 pin connectors, coaxial cable connectors, Ethernet connectors and the like.

More specifically, the media connector 200 is configured to detachably receive a media plug 26 and wire 28 assembly as illustrated. When the media plug 26 is inserted in the media connector 200, an electrical connection is formed between the media plug 26 and the media connector 200. As used herein, "electrical connection" refers both individually and collectively to the physical or electrical contact between the media connector contact pins and the corresponding contacts on the media plug. In this example, the electrical connection thus formed is shielded, insulated and/or protected by a shield 260, which effectively covers the electrical connection when the media plug 26 is inserted in the media connector 200.

In this illustration, the media plug 26 is an RJ-45 plug and the media connector 200 is sized and shaped to receive the media plug 26. The wire 28 can be coaxial cable, 10 baseT wire, or any other wire used for networks or electrical communication. The other end of the wire 28 is connected to the plug 32 that is configured to detachably mate with jack 30. The jack 30 may be electrically connected to the network, the public telephone lines, or to other systems. In this embodiment, the jack 30 is electrically connected to the LAN/WAN network socket. In this manner, the media connector 200 permits the card 14 to be electrically connected to and in communication with the LAN/WAN system.

The computer 10 may operate in a networked environment using logical connections to one or more remote computers. These remote computers may be another personal computer, a server, a router, a network PC, a peer device or other common network node, and typically include many or all of the elements described above relative to the computer 10.

Those skilled in the art will appreciate that the invention may be practiced in network computing environments with many types of computer system configurations, including personal computers, hand-held devices, multi-processor systems, microprocessor-based or programmable consumer electronics, network PCs, minicomputers, mainframe computers, and the like. The invention may also be practiced in distributed computing environments, where tasks are performed by local and remote processing devices that are linked, either by hardwired links or by a combination of hardwired or wireless links, through a communications network. In a distributed computing environment, the media connectors may be located in both local and remote processing devices.

Figure 2:
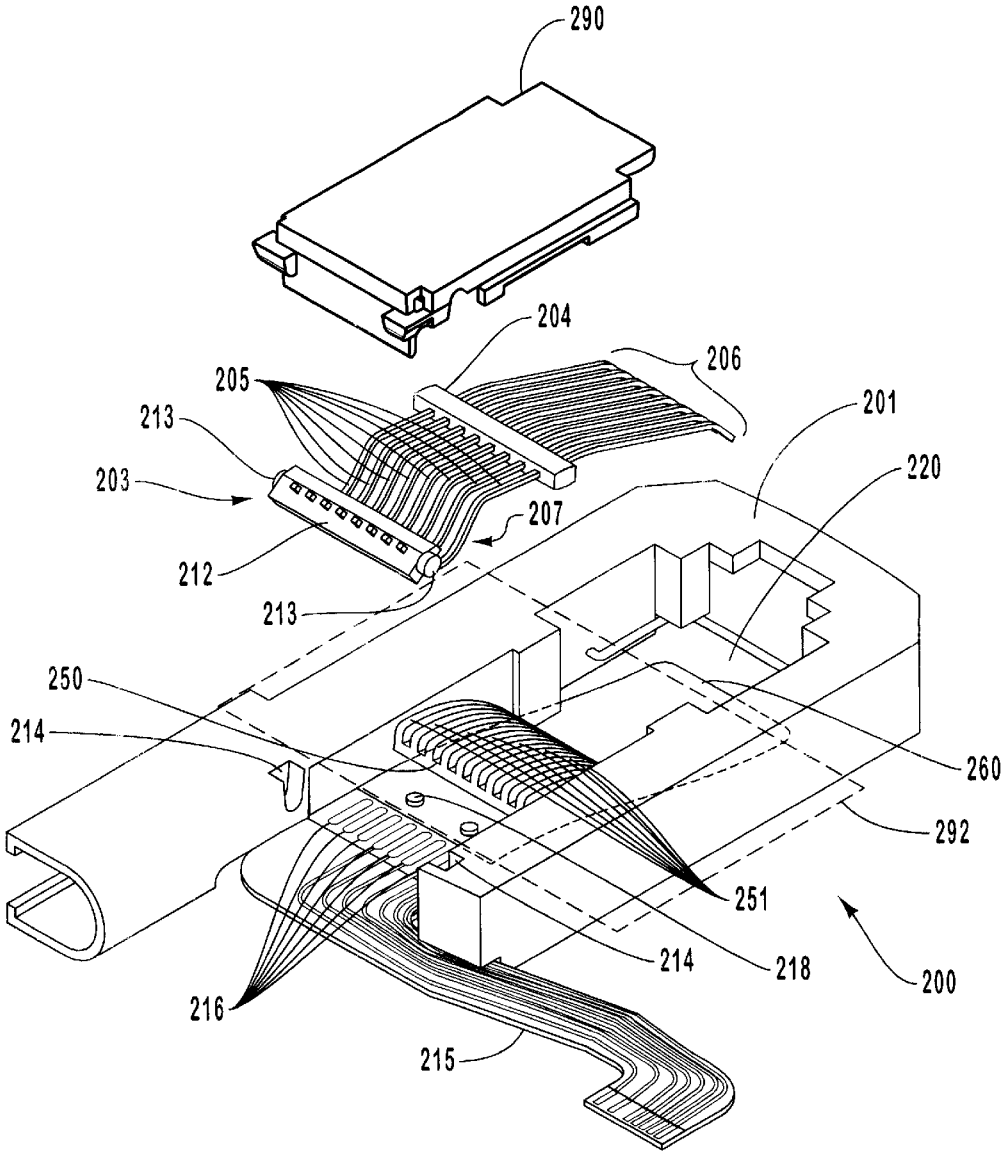
FIG. 2 is an exploded top perspective view of a media connector assembly that includes an arch disposed within a body of the media connector and a flex circuit that extends a shield beneath the media connector.

FIG. 2 illustrates an expanded top perspective view of a media connector including a shield. The media connector 200 includes a contact pin assembly 203, a top "cap" cover 290, and a retractable platform 201. As described above, the media connector 200 often serves as an interface between a portable expansion card, such as a modem or network interface card, and an external system, such as the telephone network or a computer network. When the media connector 200 is extended from an electronic device such as the card 14 (FIG. 1), a physical and electrical connection may be established at the media connector 200 by inserting a media plug or other suitable connector. When the media connector 200 is retracted within the electronic device, an electrical connection is not usually needed. The media connector 200 therefore provides for electrical communication between the card 14 and the external system in this example.

As shown in FIG. 2, the media connector 200 includes a retractable platform 201, a contact pin assembly 203, a flex circuit 215 for providing electrical connectivity between the contact pin assembly and the printed circuit board, and a cover 290 for retaining, in cooperation with the platform, the contact pin assembly and flex circuit in position. The retractable platform is configured to removably receive a media plug. The retractable platform as illustrated is configured to follow a slide track into an extended and retracted position. In one configuration, a torsion spring and guide post assist in the extension and retraction of the platform. A cam follower design enables the platform to remain in the retracted and extended positions. One configuration uses an XJACK® connector (3Com Corp., 5400 Bayfront Plaza, Santa Clara, Calif.) for the retractable platform.

The retractable platform also includes an arch 250 to help secure and protect the contact pin assembly. The arch 250 includes a plurality of contact pin fins or guides 251. The retractable platform 201 receives the contact pin assembly 203 including contact pins 205 for providing electrical contact between contacts on the media plug 26 (FIG. 1) and the electronic device or card 14, preferably via a flex circuit 215. When the contact pins 205 are secured within the body of the retractable platform, the pin guides 251 are shaped to ensure that the contact pins 205 are correctly positioned within the media connector 200 and that the fingers 206 are properly positioned within the aperture 220 of the retractable platform. The contact pin guides 251 keep the contact pins 205 properly aligned and separated because each individual contact pin rests within a separate pin guide. When the contact pins 205 are properly positioned within the contact pin guides 251, the spacer 204 rests against a top surface of the arch 250. Advantageously, the pin guides 251 thereby prevent the individual contact pins 205 from touching each other, which prevents electrical shorts or other malfunctions. The arch 250 is also shaped to allow the contact pins 205 to bend or flex within their prescribed range of motion as a media plug is inserted and removed from the media connector 200. Over extension of the contact pins outside their prescribed range of motion can fracture the contact pins. The arch 250 provides the contact pins 205 with the necessary support to resist flexing beyond the prescribed limits.

Further illustrated in FIG. 2, the media connector 200 includes flex circuit 215. A flex circuit is used to connect the media connector 200 to a printed circuit board (not shown) generally housed within a potable expansion card. Flex circuits also provide an added space conservation benefit by drastically reducing the amount of printed circuit board space required to include a retractable platform. Typically the flex circuit possesses a total construction thickness of about twelve thousandths of an inch or less, although a thicker flex circuit does not diminish the overall advantages of the invention and thickness should not be construed as a limiting factor. In the retracted position the flex circuit is positioned tightly against the retractable platform, as the platform extends the flex circuit occupies a portion of the space vacated by the platform. Normally, each electrical trace within the flex circuit 215 is enclosed within a non-conductive covering, but each trace is exposed at the electrical contact pads 216 or the point of contact 217 (shown in FIG. 3) with the contact pins 205. The electrical contact pads 216 allow for some variance in the placement of the contact pins 205, but the retractable platform aligns the flex circuit and the contact assembly to ensure proper electrical contact.

To facilitate the actual compression connection interface, the contact pins 205 further include a second end portion 207 having a flexible spring profile. Second end portion 207 provides a flex region for accommodating compression by cover 290 against flex circuit 215 and more specifically at contact pads 216. Contact pads 216 are exposed electrically conductive portions of the tracks or traces within flex circuit 215 which provide a non-electrically insulated interface for physically coupling with the second end portion 207 of contact pins 205. Contact pads 216, in the preferred embodiment, assume and elongated and widened portion of the conductive trace to facilitate alignment variations when the contact pins are under compressive force when filly assembled as a result of installation of the cover 290 within platform 201.

Figure 3:
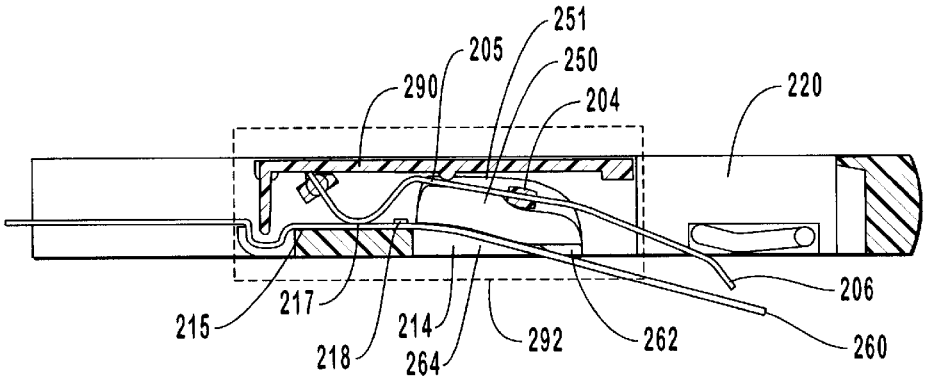
FIG. 3 is a cross sectional view of a media connector that illustrates the compressed positioning of the contact pins on the opposite side of the arch from the shield.

In one configuration, two plastic posts are molded into the retractable platform of the media connector assembly to align with the flex circuit, which has opposing holes, and is inserted over the tops of the posts. This alignment creates a positive stop and lock motion for the inserted flex circuit, thereby increasing the reliability and reducing the production technology costs needed to ensure proper alignment and assembly of the media connector. Another configuration uses the process of Liquid Photo Imaging applied to the flex circuit in the proper thickness to create grooves or "jail-house bars" to improve contact alignment of the pins on the pads. When properly assembled, the contacts pins 205 are seated directly over the electrical contact pads 216 of the flex circuit 215. Cover 290 compresses the pins and pads together (as illustrated in FIG. 3) when the cover is inserted and locked into the retractable platform. Molded locking features on the media connector assembly 200 secure the entire system including the cover, the contact pin assembly, the flex circuit, and the platform.

The illustrated flex circuit is configured with a shield 260 that extends beneath the fingers 206 of the contact pins 205. The shield 260 is positioned on the opposite side of the arch 250 from the contact pins 205 and exits the retractable platform through an arch channel described with reference to FIG. 3. One function of the shield 260 is to insulate and protect the contact pins 205 from being touched or shorted by an external source. More generally, the shield 260 insulates and protects the electrical connection between the media connector and a media plug.

The cover 290 of the media connector 200 is also shown separated from the retractable platform for clarity and is normally securely connected to the retractable platform to enclose and compress the contact pin assembly within the media connector 200. Additionally, the cover 290 prevents inadvertent contact with the exposed portion of electrical contact pads 216 on the flex circuit 215. Molded locking features on the media connector assembly 200 secure the cover 290 to the retractable platform. Cover 290 compresses the pins and pads when locked into place. Cover 290 is described in greater detail in FIG. 4.

The contact pin assembly 203 comprises a plurality of contact pins 205 that are separated from one another using a carrier 212 and a spacer 204. In FIG. 2, the contact pins 205 are illustrated separate from the retractable platform for clarity. The carrier 212 that helps to separate the individual contact pins 205 has opposing extensions 213 that are shaped and configured to rest in slots 214 of the retractable platform on the media connector 200. In addition, the contact pins 206 are also aligned via the pin guides 251 of the arch 250. When the extensions 213 rest in the slots 214 and the fingers 206 are within the pin guides 251, each of the contact pins 205 are positioned to form an electrical connection with a corresponding electrical contact pad 216 of flex circuit 215 when the contact assembly is compressed. In one configuration, carrier 212 is shaped to conform to cover 290 and helps compress the contact pins 205 against the contact pads 216. Another configuration uses spacer 204 and carrier 212 to compensate for the additional insertion force placed on the contact fingers 206 when a media connector plug is inserted into aperture 220. The spacer 204 limits the amount of force transferred from insertion over the arch into the contact area and the carrier 212 presses against the cover 290 to generate an opposing force to counterbalance the insertion forces. The end effect is to generate more compression of the contact pins on the contact pads, thereby ensuring electrical contact.

The shape of the contact pin assembly between the carrier 212 and spacer 204 may be altered in accordance with the design parameters of the compression fitting. For example, one preferred embodiment locks the contact pins into place and creates an electrical contact between the contact pins 205 and the electrical contact pads 216 through a compression fitting. Another embodiment alters the shape of the contact pin assembly so as to use the compression fitting to pierce the electrical contact pads 216 on the flex circuit.

When the media connector 200 is assembled, the fingers 206 of the contact pins 205 extend into aperture 220 formed in the media connector 200. The aperture 220 shown in this example is shaped and configured to removably receive a media plug (shown in FIG. 1). The contact pins 205 are configured to bend or flex as the media plug is inserted and removed from the aperture 220 in a manner that ensures a good electrical connection between the contact pins 205 and corresponding contacts positioned on the media plug. The contact pins 205 are preferably configured to flex within a range of motion such that the contact pins 205 do not fracture or otherwise malfumction. The motion experienced by the contact pins 205 when a media plug is removed and inserted into the aperture 220 is typically within the prescribed range of motion.

Referring again to FIG. 2, the flex circuit 215 is secured to the media connector 200, in this example, by rivets or posts 218, although other connectors may be used to secure the flex circuit 215 to the media connector 200. In this example, the shield 260 is a non-conductive extended portion of the flex circuit 215, preferably without electrical contact pads or other circuit elements. The shield 260 thus has substantially insulative properties. Creating the shield 260 in this manner as a portion of the flex circuit 215 facilitates manufacture of the media connector and the shield. Alternafively, the shield 260 can be constructed of an insulative material that is separate from the flex circuit 215. In this case, the shield 260 would still attach to the media connector and function as described herein. Another advantage of the shield 260 is that it is flexible and has high material memory. In other words, the shield 260 will not deform or become misshaped with use and will function to protect and insulate the electrical connection between the media connector 200 and a media plug. The shield 260 tends to press against the contact pins 205 or the electrical connection in a manner that insures that the electrical connection created when a media plug is inserted in the media connector is covered, protected, and/or insulated.

FIG. 3 is a cross sectional view of the media connector 200 shown in FIGS. 1 and 2 that more fully illustrates the compression fitting and functions of the shield 260 and the arch 250. FIG. 3 also illustrates the cover 290 and the contact pins 205 connected with the media connector 200. In FIG. 3, point 217 corresponds to the contact point between the exposed electrical contact pads 216 and the contact pins 205 forming the compression connection or interface that couples the flex circuit to the media connector. Because the cover 290 is securely connected with the body 292 of the media connector 200, the cover 290 partially ensures that the electrical connection at point 217 is continuous. Specifically, the contact pins are compressed or flattened against the contact pads at the contact point through pressure asserted by the cover against the contact pin assembly. For example, the cover 290 applies pressure against the carrier 212 and the contact pins 205 to maintain physical contact at point 217 between the contact pins 205 and the exposed portion of the electrical contact pads 216.

The contact pins 205 extend over the arch 250 and the fingers 206 of the contact pins 205 exit the body 292 of the media connector 200 into the aperture 220. FIG. 3 also illustrates how the contact pins 205 rest within the pin guides 251, which extend outwardly from the arch 250. Portions of the contact pins 205 are contained within the body 292 of the media connector 200 and only the fingers 206 of the contact pins 205 are exposed in the aperture 220. As illustrated, the spacer 204 rests against the arch 250 and the individual contact pins are positioned within pin guides 251 of the arch 250. As previously stated the pin guides 251 ensure that the individual contact pins 205 do not come into contact with one another and that the fingers 206 of the contact pins 205 are properly positioned within the aperture 220. Also, the contact pins 205 are not hindered in their prescribed movements by the arch 250 or the cover 290. Instead, the arch 250 is shaped to ensure that the contact pins 205 move within their prescribed range of motion as a media plug is repeatedly removed and inserted in the aperture 220 of the media connector 200.

FIG. 3 also illustrates that the media connector 200 includes an arch channel 264 beneath the arch 250. The shield 260 exits the body 292 of the media connector 200 through the arch channel 264. The shield 260 is therefore positioned beneath the arch 250 with respect to the contact pins 205. The shield 260 has sufficient length to extend beneath the fingers 206 of the contact pins 205. The shield 260 does not hinder or interfere with the movement of the contact pins 205 because the contact pins 205 are located on the opposite side of the arch 250 from the shield 260.

The media connector 200 further includes a groove 262. The groove 262 extends along a bottom portion of the arch 250 and has a depth that is substantially equal to a thickness of the shield 260, which enables the shield 260 to be accommodated within the body of the media connector 200 when the media connector 200 is retracted. The groove 262 thus ensures that the shield 260 does not interfere with the extension and retraction of the media connector 200 from an electronic device such as a portable expansion card. The groove 262 extends along the bottom of the arch 250 and from the arch channel 264 to the aperture 220. The groove 262 also enables an end of the shield 260 to extend into the aperture 220 when the media connector 200 is retracted and the shield 260 is therefore contained within the confines of the media connector 200 when retracted. When the media connector 200 is extended, the shield 260 falls away from the media connector 200 and is positioned beneath the aperture 220 in a manner that permits the shield 260 to cover the fingers 206 when a media plug is inserted in the media connector 200.

Figure 4:
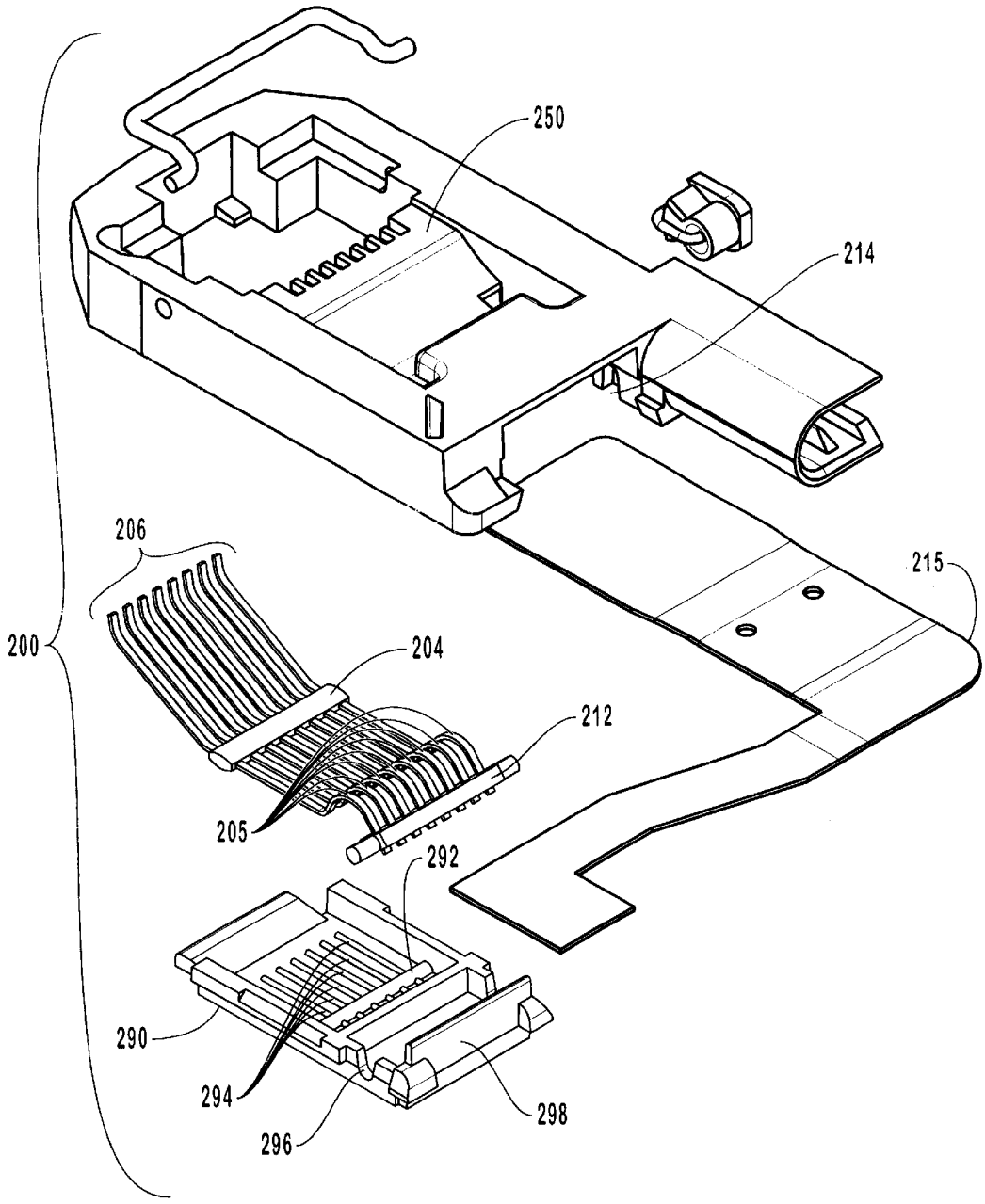
FIG. 4 is an exploded bottom perspective view of a media connector assembly including compression cover and contact pin assembly.

FIG. 4 illustrates an expanded bottom perspective view of a media connector including a compression cover. As previously illustrated in FIG. 2, the media connector 200 illustrated in FIG. 4 includes a contact pin assembly, a flex circuit, a top "cap" cover, and a retractable platform. The cover 290 is generally constructed of rigid plastic material that can be locked into the retractable platform. The cover 290 is shown separated from the retractable platform for clarity and is normally securely connected to the retractable platform to enclose and compress the contact pin assembly within the media connector 200. When secured in place, the cover 290 prevents inadvertent contact with the exposed portion of electrical contact pads 216 on the flex circuit 215. Molded locking features on the media connector assembly 200 secure the cover 290 to the retractable platform. Slot 296 captures the extensions of the contact pin assembly and guides the carrier 212 into the retractable platform. When properly aligned a compression ridge 292 presses against the contact pin assembly to compress the contact pins and pads together when the cover 290 is locked into place on the retractable platform. Alignment fins 294 provide additional rigidity for the cover 290, but more importantly assist in the alignment of the contact pins 205 within the pin guides 251 on the arch 250. When the cover 290 is proper locked into position, end wall 298 presses the flex circuit against the retractable platform. The end wall 298 prevents exposure of the contact pads 216 and holds the flex circuit 215 flat in place to optimize the compression contacts, especially during the extension and retraction of the media connector.

Figure 5:
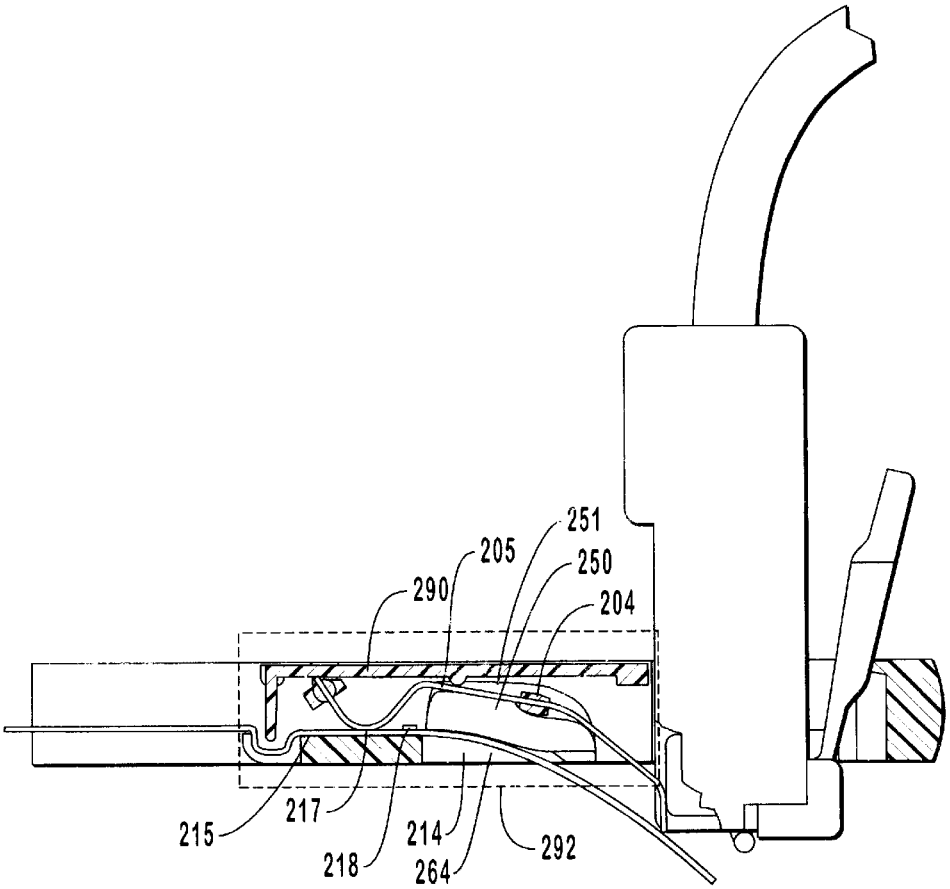
FIG. 5 is a cross sectional view of a media connector that illustrates the contact pin deflection when an RJ-45 media plug is inserted therein.
Figure 6:
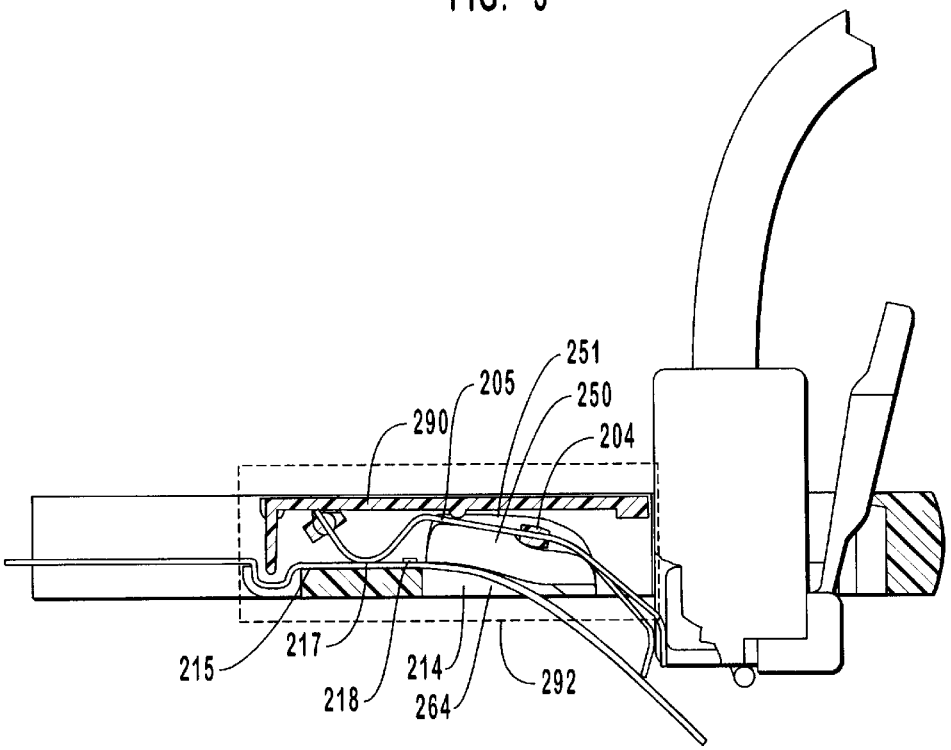
FIG. 6 is a cross sectional view of a media connector that illustrates the contact pin deflection when an RJ-11 media plug is inserted therein.

FIGS. 5 and 6 depict the media connector 200 as a multifunction media connector that is capable of coupling with both RJ-11 and RJ-45 media plugs. Such a multifinction media connector finds utility in applications where space, such as surface edge connection space is at a minimum and multiple dedicated connectors is impractical or at least undesirable. The multifunction media connector also finds application in reduction of confusion among less sophisticated users that may otherwise inadvertently connect an apparently compatible smaller connector into a larger connector aperture resulting in possible serious damage to overly stressed unmatched contact pins.

It should be appreciated that the contacts of media plugs are recessed within the molded physical plug. Such recessed contacts allow the contact pins 206 to align with the contacts of the media plug without excessive flexure, and possible damage, to contact pins 206 when media plug 26 (FIG. 1) encounters and is received by retractable platform 201 within aperture 220. The multifunction media connector of the present invention is fully populated with contact pins 206 to accommodate full functionality of an RJ-45 plug. However, when a lesser populated media plug having a smaller physical dimension, such as an RJ-11 media plug, encounters and is received by retractable platform 201 within aperture 220, portions of the physical media plug that do not exhibit contact recesses align with at least the outer contact pins 206 and cause significant additional flexure of the outside ones of contact pins 206. The present invention provides an extended moment arm and curved flexure support for each of the contact pins to accommodate such additional flexure.

FIG. 5 is a cross sectional view of the media connector 200 shown in the previous figures that more fully illustrates the compatibility of an RJ-45 media plug with media connector 200. The generally perpendicular interface between media plug 26 and the thin profile of media connector 200 results in a sizeable deflection of contact pins 206 in order to ensure a reliable physical contact as well as due to the acceptance of the media connector 26 substantially within aperture 220 (FIG. 2) for accommodating the retention mechanisms.

As shown in FIG. 5, media connector 200 includes a platform 201 having an aperture formed toward a first end for physically receiving media plug 26' and a body 292 toward a second end. Media connector 200 also includes at least one contact pin 206 which has a first end that extends into the aperture 220 (FIG. 3) for electrically coupling with contact pins on media connector 26'. Contact pins 206 also have a second end for attaching either directly or indirectly through a flex circuit to an electronic device. Media connector 200 further includes an arch within body 292 for radially deflecting contact pin 206 from the first end extending into the aperture along arch 250 along arch 250. Upon the insertion of media plug 26', contact pins 206 deflect over an extended length extending from aperture 220 (FIG. 3) back well into body 292 and are supported by arch 250 during their deflection.

FIG. 6 is a cross sectional view of the media connector 200 shown in the previous figures that more filly illustrates the compatibilitiy of an RJ-11 media plug with media connector 200. As discussed, the generally perpendicular interface between the media connector and media plug results in a sizeable deflection of contact pins 206. However, when the media plug assumes a configuration that does not provide recessed contacts for each of the contact pins of the media connector, the outermost contact pins are further deflected by the media plug side regions or shoulders which requires an even more enhanced deflection of the contact pins.

In FIG. 6, a media plug 26" assumes an RJ-11 configuration which subjects the contact pins to the variations in deflection as described above. Upon insertion of media plug 26" into aperture 220 (FIG. 3), contact pins 206' are received into the recessed contact portion of media plug 26" and deflect similarly as described above, i.e., along arch 250 that is located within body 292 of platform 201. However, that contact pins 206" that are generally on the outer sides of the contact pin array, are subjected to the additional deflection as shown. While such a deflection exceeds the deflection of contact pins 206', the deflection of contact pins 206" are accommodated without damage due to the arching effect of deflection along arch 250 within body 292.

A media connector for providing an electrical interface between an external system and an electronic device has been presented. The media connector includes a platform with an aperture formed therein for receiving a media plug, a contact pin assembly, and an arch within the body of the platform for radially deflecting the contact pin array at a point well remote from the beginning edge of the aperture without causing damage to the contact pin assembly.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A media connector that allows electrical communication to be established with a media plug, the media connector comprising:

a platform including a body and an aperture that is sized and configured to receive the media plug;

one or more contact pins, each of the one or more contact pins including a first end that extends into the aperture to allow electrical communication to be established with the media plug when the media plug is received within the aperture; and an arch formed in the body of the platform, the arch including a curved outer surface that is sized and configured to contact at least a portion of the one or more contact pins, the arch being sized and configured to control the radial deflection of the contact pins as the media plug is received within the aperture.

2. The media connector as in claim 1, wherein the curved outer surface of the arch being sized and configured to support the one or more contact pins in a first position when the media plug is not received within the aperture and a second position when the media plug is received in the aperture.

3. The media connector as in claim 1, wherein the aperture is sized and configured to receive an RJ-45 media plug and an RJ-11 media plug.

4. The media connector as in claim 1, wherein the contact pins comprise one or more inner contact pins and one or more outer contact pins, the inner contact pins being sized and configured to elastically engage one or more electrical contacts on the media plug when it is received in the aperture, and the outer contact pins are sized and configured to elastically age shoulders of the media plug when it is received in the aperture.

5. The media connector as in claim 1, further comprising a spacer that is connected to the one or more contact pins and configured to retain the one or more contact pins in a generally parallel configuration.

6. The media connector as in claim 1, further comprising a flex circuit connected to the platform and including one or more contact pads, the contact pads being sized and configured to be in electrical contact with the one or more contact pins.

7. The media connector as in claim 1, further comprising a plurality of pin guides on the curved outer surface of the arch, each of the plurality of pin guides being sized and configured to receive a portion of a contact pin from the one or more contact pins and to prevent electrical communication between the contact pins.

8. The media connector as in claim 1, wherein the outer surface of the arch is sized and configured to prevent inelastic deformation of the one or more contact pins when the media plug is received in the aperture.

9. The media connector as in claim 1, wherein the contact pins comprise one or more inner contact pins and one or more outer contact pins, the inner contact pins being sized and configured to deflect a first amount to engage one or more electrical contacts on the media plug when it is received in the aperture, the outer contact pins being sized and configured to deflect a second amount to engage shoulders of the media plug when it is received in the aperture; and wherein neither the first amount of deflection nor the second amount of deflection is sufficient to damage the contact pins.

10. An electrical connector that is sized and configured to be electrically connected to an electrical device, the electrical connector comprising:

a platform including an aperture that is sized and configured to selectively receive a media plug;

one or more contact pins connected to the platform, each of the contact pins including a first end and a second end, the first end extending into the aperture to allow electrical communication to be established with the media plug when it is received within the aperture;

an arch with a curved outer surface that is formed in the retractable platform, the arch being is sized and configured to position the contact pins to come into contact with one or more contacts of the media plug and to allow radial deflection of the one or more contact pins along the arch when encountered by the one or more contacts of the media plug;

a flex circuit having one or more electrical traces electrically connected to the platform, the traces having one or more electrical contact pads; and a cover connected into the platform, the cover engaging the one or more contact pins and causing the second ends of the one or more contact pins to be electrically connected to the one or more electrical contact pads of the flex circuit to form an electrical connection between the contact pins and the flex circuit.

11. The electrical connector as in claim 10, wherein the curved outer surface of the arch is sized and configured to support the one or more contact pins in a first position when the media plug is not received within the aperture and a second position when the media plug is received in the aperture.

12. The electrical connector as in claim 10, wherein the contact pins comprise one or more inner contact pins and one or more outer contact pins; the inner contact pins being sized and configured to engage one or more electrical contacts on the media plug when it is received in the aperture; and the outer contact pins are sized and configured to engage shoulders of the media plug when it is received in the aperture.

13. The electrical connector as in claim 10, further comprising a spacer that is connected to the one or more contact pins and configured to retain the one or more contact pins in a generally parallel configuration.

14. The electrical connector as in claim 10, further comprising a plurality of pin guides on the curved outer surface of the arch, each of the plurality of pin guides being sized and configured to receive a portion of a contact pin from the one or more contact pins.

15. The electrical connector as in claim 10, wherein the outer surface of the arch is sized and configured to prevent inelastic deformation of the one or more contact pins when the media plug is received in the aperture.

16. The electrical connector as in claim 10, wherein the contact pins comprise one or more inner contact pins and one or more outer contact pins, the inner contact pins being sized and configured to deflect a first amount to engage one or more electrical contacts on the media plug when it is received in the aperture, the outer contact pins being sized and configured to deflect a second amount to engage shoulders of the media plug when it is received in the aperture; and wherein neither the first amount of deflection nor the second amount of deflection is sufficient to damage the contact pins.

17. A retractable media connector that allows electrical communication to be established between an electronic device and a media plug, the media connector comprising:

a retractable platform that is movable between an extended position and a retracted position, the retractable platform including a body and an aperture that is sized and configured to receive the media plug;

one or more contact pins, each of the one or more contact pins including a first end that extends into the aperture to allow electrical communication to be established with the media plug when the media plug is received within the aperture; and an arch formed in the body of the retractable platform, the arch including a curved outer surface that is sized and configured to contact at least a portion of the one or more contact pins, the arch being sized and configured to control the radial deflection of the contact pins as the media plug is received within the aperture.

18. The retractable media connector as in claim 17, wherein the curved outer surface of the arch is sized and configured to prevent inelastic deformation of the one or more contact pins when the media plug is received within the aperture.

19. The retractable media connector as in claim 17, wherein the aperture is sized and configured to receive an RJ-45 media plug and an RJ-11 media plug.

20. The retractable media connector as in claim 17, wherein the contact pins comprise one or more inner contact pins and one or more outer contact pins, the inner contact pins being sized and configured to engage one or more electrical contacts on the media plug when it is received in the aperture, the outer-contact pins are sized and configured to engage shoulders of the media plug when it is received in the aperture.

21. The retractable media connector as in claim 17, further comprising a flex circuit connected to the platform and including one or more contact pads, the contact pads being sized and configured to be in electrical contact with the one or more contact pins.

22. The retractable media connector as in claim 17, further comprising a plurality of pin guides on the curved outer surface of the arch, each of the plurality of pin guides being sized and configured to receive a portion of a contact pin from the one or more contact pins.

23. An electrical connector that is sized and configured to be electrically connected to an electrical device, the electrical connector comprising:

a retractable platform with an aperture that is sized and configured to receive a media plug;

one or more contact pins, at least a portion of the contact pins extending into the aperture in the retractable platform to allow electrical communication to be established with the media plug with it is received within the aperture;

an arch formed in the retractable platform, the arch including a curved outer surface that is sized and configured to engage at least a portion of the one or more contact pins, the outer surface of the arch being sized and configured to allow radial deflection of the one or more contact pins when the media plug is inserted into the aperture;

one or more pin guides in the outer surface of the arch, the pin guides being sized and configured to position the one or more contact pins to come into contact with the one or more contacts of the media plug and to prevent electrical contact between the one or more contact pins; and a flex circuit having one or more electrical traces electrically connected to the retractable platform, the traces having one or more electrical contact pads, the flex circuit being configured to allow electrical communication between the one or more contact pins and the one or more contact pads of the flex circuit.

24. The electrical connector as in claim 23, wherein the outer surface of the arch is sized and configured to prevent inelastic deformation of the one or more contact pins when the media plug is received within the aperture.

25. The electrical connector as in claim 23, further comprising a cover connected into the retractable platform, the cover engaging the one or more contact pins and causing the one or more contact pins to be electrically connected to the one or more electrical contact pads of the flex circuit.

* * * * *

UNITED STATES PATENT AND TRADEMARK OFFICE

CERTIFICATE OF CORRECTION

PATENT NO. : 6,457,994 B1
DATED : October 1, 2002
INVENTOR(S) : Thomas A. Johnson et al.

It is certified that error appears in the above-identified patent and that said Letters Patent is hereby corrected as shown below:

Title page,
Item [75], Inventors, change "Steven Loforte" to -- Steven LoForte --

Column 1,
Line 25, change "systems," to -- systems --

Column 2,
Line 27, change "movable" to -- moveable --
Line 41, change "post" to -- posts --

Column 9,
Line 15, change "potable" to -- portable --

Column 12,
Line 52, change "proper" to -- properly --

Column 13,
Line 43, after "aperture" change "along arch 250 along arch 250." to -- along arch 250. --
Line 67, after "However," change "that" to -- the --

Column 14,
Line 57, after "elastically" change "age" to -- engage --

Column 15,
Line 32, after "arch" change "being is sized" to -- being sized --

UNITED STATES PATENT AND TRADEMARK OFFICE

CERTIFICATE OF CORRECTION

PATENT NO. : 6,457,994 B1 
DATED : October 1, 2002
INVENTOR(S) : Thomas A. Johnson et al.

It is certified that error appears in the above-identified patent and that said Letters Patent is hereby corrected as shown below:

Column 17,
Line 4, after "plug" change "with" to -- when --

Signed and Sealed this

Eighteenth Day of March, 2003

JAMES E. ROGAN
*Director of the United States Patent and Trademark Office*